United States Patent [19]

Mitsui

[11] 4,258,624

[45] Mar. 31, 1981

[54] MINIATURIZED PRINTER

[75] Inventor: Yoshihiro Mitsui, Shiojiri, Japan

[73] Assignees: Shinshu Seiki Kabushiki Kaisha; Kabushiki Kaisha Suwa Seikosha, both of Tokyo, Japan

[21] Appl. No.: 957,967

[22] Filed: Nov. 6, 1978

[30] Foreign Application Priority Data

Nov. 4, 1977 [JP] Japan ..... 52-148052[U]

[51] Int. Cl.[3] ..... B41J 1/44

[52] U.S. Cl. ..... 101/99; 101/93.22; 101/110; 235/92 MP

[58] Field of Search ..... 101/99, 110, 111, 93.22, 101/93.29–93.34; 235/435, 437, 441, 92 MP, 92 CT, 92 EA

[56] References Cited

U.S. PATENT DOCUMENTS

| | | | |
|---|---|---|---|
| 2,350,454 | 6/1944 | Goebel | 101/99 |
| 2,874,634 | 2/1959 | Hense | 101/110 X |
| 3,049,992 | 8/1962 | Brown et al. | 101/99 |
| 3,141,402 | 7/1964 | Howard | 101/110 X |
| 3,141,403 | 7/1964 | Brown et al. | 101/110 X |
| 3,731,622 | 5/1973 | Baranoff | 101/110 X |
| 4,142,463 | 3/1979 | Mitsui et al. | 101/110 X |

*Primary Examiner*—Edward M. Coven

*Attorney, Agent, or Firm*—Blum, Kaplan, Friedman, Silberman & Beran

[57] ABSTRACT

A small-sized printer having print characters circumferentially disposed around a plurality of print rings rotating by a motor on a common shaft, includes a detector comprised of an integrated circuit board rotating on the same shaft. The rotating circuit board incorporates conductive foil contacts which are sensed during rotation by fixed brushes, thereby providing a series of pulses indicative of the rotational position of the shaft and of the print characters which are in position for printing. An auxiliary signal, generated by additional contacts on the rotating circuit board, indicate positions between the print characters on the print rings. Logic circuitry combines the actual position pulses with the auxiliary signals to output converted position pulses which are free of noise and irregularities in waveform normally associated with brush contact switches. These converted pulses provide accurate timing as is required for the print cycle. A motor stop signal is also provided.

12 Claims, 5 Drawing Figures

FIG. 1
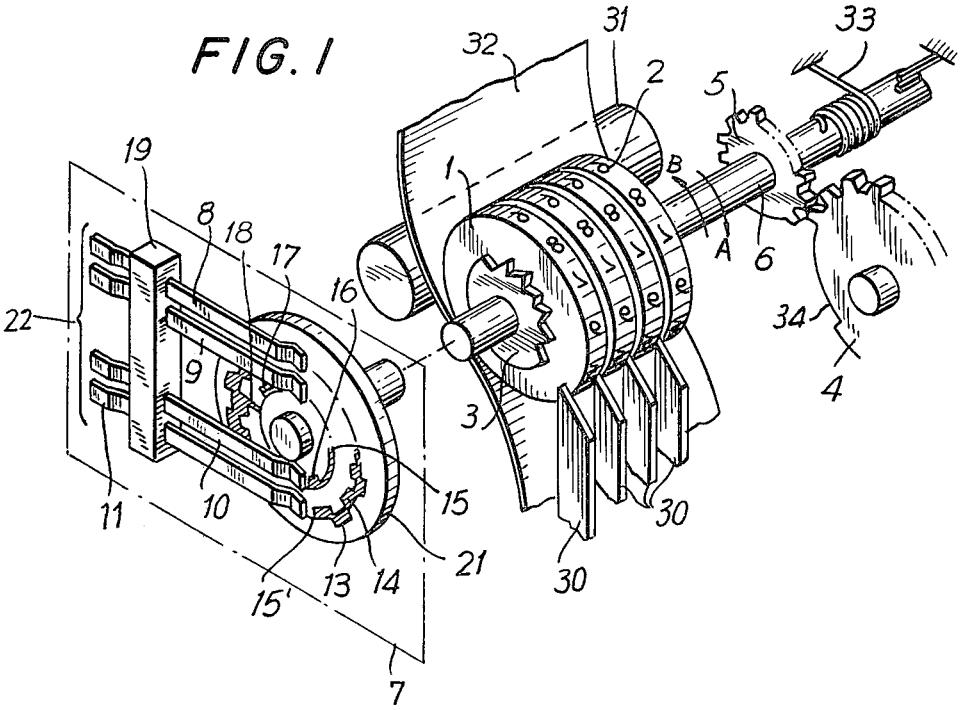
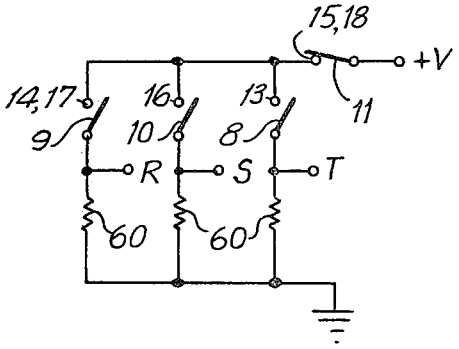
FIG. 2
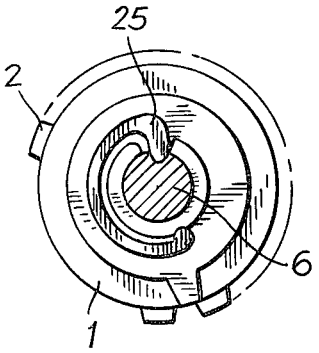
FIG. 3

MINIATURIZED PRINTER

BACKGROUND OF THE INVENTION

This invention is directed generally to a small-sized printer of the type having a plurality of print rings with print characters circumferentially disposed therearound, and in particular to an improved detection arrangement for use with a small-sized printer of the type utilized in a desk calculator. The detector provides position signal pulses which control the entire print cycle including a stop signal for the motor which drives the print rings.

Miniaturized printers, of the type utilized to provide a permanent record in a desk calculator or other computing instruments, such as a cash register or the like, are characterized by the use of a drive motor which is energized during printing and de-energized when the printer is not in use. When the printer is in use a supply voltage is applied to the drive motor to effect an energization of the motor during a complete printing cycle of the printer. The printing cycle includes positioning of the print rings for printing, the printing operation, and return of the print rings to a standby position wherein each of the print rings is aligned in a rest position so that the next printing cycle can commence. Copending U.S. Patent Application Ser. No. 828,685 discloses a printer having mechanical features similar to the printer disclosed herein.

Due to the rapid speed with which the information can be processed by small-sized electronic instruments, such as desk calculators, electronic cash registers, and the like, it is desired that the entire printing cycle of the printer be completed at higher speeds with greater accuracy and at less expense. Heretofore, printers of the prior art have utilized two distinct detector arrangements for controlling the print cycle of the printer. In one type of apparatus, the detector includes a light emitting source and a photo-sensitive receiver element. A rotating disc having slots is rotated so as to intermittently intercept the light passage between the source and the light receiver. With such an arrangement a series of high quality pulses can be produced to control the print cycle. However, the constant current supplied to the light emitting diode, which generally serves as the light source, constitutes a high power drain. Such a detecting apparatus is shown in U.S. Pat. No. 3,148,616 by Miesiak, wherein a light source, a code disc and light-sensitive photo diodes are used in providing a detection system.

Another apparatus for detecting the position of print rings in a printer includes the use of rotating brushes and printed contacts on a circuit board. As the brushes pass over the contacts, signals are generated indicative of the position of the brushes and of the print wheels. Such an apparatus is shown in the U.S. Pat. No. 3,731,622 by Baranoff. By elimination of the light source and the photo detector, substantial savings are made in power consumption of the printer device. However, brushes and contacts produce less than a totally satisfactory signal output, in that chattering between the brushes and the contact points tends to produce erratic, irregular and noisy signals. Such signals when fed to the logic circuitry can produce erroneous outputs. Further, such chattering between contacts and brushes is a degenerative process which worsens with usage. Thus a detector using mechanical contacts and brushes, although it has low initial cost and continuously uses a low amount of power, has not been suited to printers of the type described herein.

Accordingly, what is needed is a detector having the low cost and low power consumption of mechanical brushes and printed contacts, combined with the reliability of a detector disc using a light source and photodetector.

SUMMARY OF THE INVENTION

Generally speaking, in accordance with the instant invention, a small-sized printer has an improved detection arrangement for providing output signals used in controlling the duration of a print cycle and the sequence of printing operations performed by the printer. The printer includes a plurality of print rings having print characters circumferentially disposed therearound. The print characters are selectively positioned in a print position by rotation of each of the print rings in a first rotational direction from a rest position to a print position during each print cycle. A rotational drive arrangement including a motor, is adapted, in response to being energized, to rotatably drive the print rings from a rest position to a print position during each print cycle. The invention is particularly characterized by a brush and contact arrangement for detecting the rotational position of the print rings and for generating a character position timing signal representative of each of the rotational positions of the print rings. Each rotational position of the print rings corresponds to a print character circumferentially disposed about the print rings. A solenoid actuated print selector is associated with each of the print rings for selectively stopping each of the print rings at a respective predetermined print position during each print cycle in response to timing signals produced by the brush and contact detector arrangement. An auxiliary signal, generated by additional contacts and brushes, indicates positions which are between the print characters on the print rings. All of the switch contacts are located on a rotating circuit board which is directly connected to the shaft which drives the print rings. Logic circuitry combines the actual position pulses with the auxiliary signals to output converted position pulses which are free of noise and irregularities normally associated with brush-contact switches. These converted pulses provide accurate timing as is required for the print cycle. A motor stop signal is also provided by means of the rotating circuit board and brushes.

Accordingly it is an object of the instant invention to provide a detector apparatus which is reliable, inexpensive to produce, and low in power consumption.

A further object of the instant invention is to provide a position detector apparatus which provides position signals which are free of noise and chattering effects normally associated with brush and contact switches.

Still another object of the instant invention is to provide a position detector apparatus which uses an auxiliary signal to indicate positions between the positions of the print characters.

Yet another object of the instant invention is to provide a position detector apparatus which is capable of outputting a plurality of different signals related to the print cycle.

A significant object of the instant invention is to provide a position detector apparatus which is suited to a miniaturized battery-operated printer.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIG. 1 is a perspective view of a miniaturized printer including a detection assembly constructed in accordance with a preferred embodiment of the instant invention;

FIG. 2 is a circuit including the switches and contacts of FIG. 1 for producing signals synchronized with the rotation of print rings;

FIG. 3 is a sectional view of the print rings of FIG. 1;

DETAILED DESCRIPTION OF THE INVENTION

Figure 4:
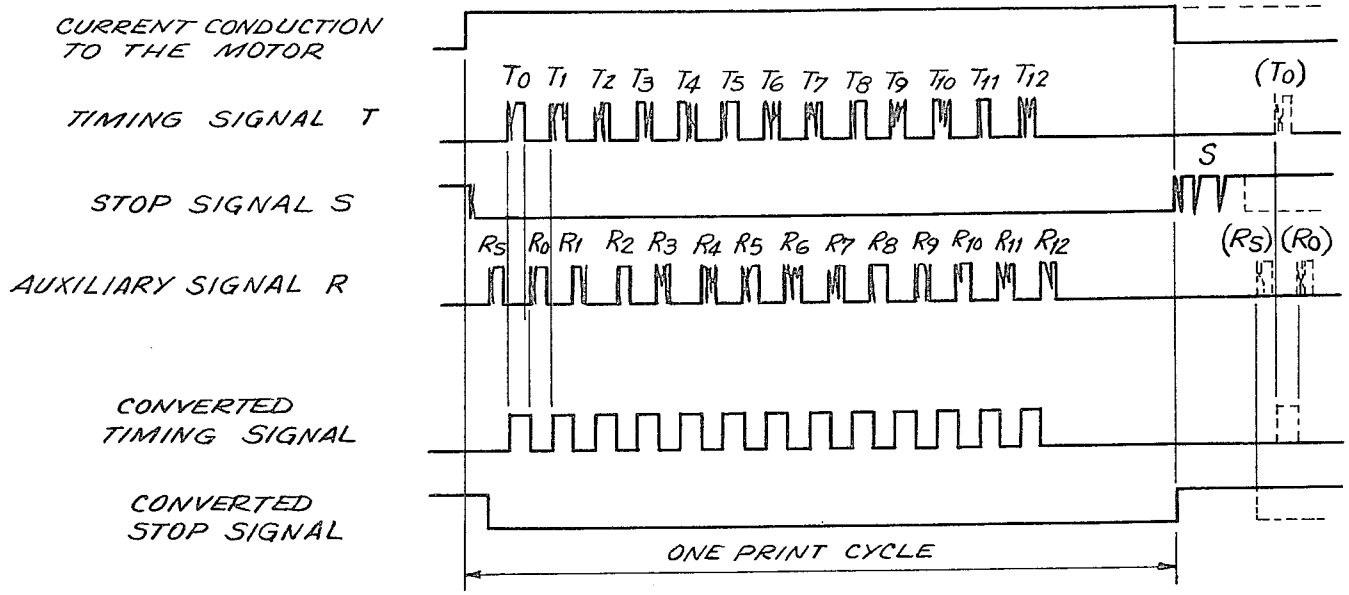
FIG. 4 is a wave-form diagram showing signal outputs associated with the embodiment of FIG. 1 and the logical circuits of FIG. 5.

FIG. 1 shows an embodiment of a printer including the electromechanical position detector of this invention. A print cycle includes five basic steps, namely, supplying electric power to the motor (not shown). The motor until ordered to print is stopped and remains at a standby position. When the motor is running characters on print wheels are rotated to the desired print position. Then the selected characters are printed on a paper web, after which the paper in the machine is advanced and the print rings are returned to their standby position ready for the initiation of a second cycle. At the completion of one cycle the motor is stopped.

The miniaturized printer includes a character ring 1 provided with characters 2 such as letters, symbols and the like positioned circumferentially therearound. A ratchet 3 is provided on the side face of the print ring and rotates as one body with the print ring. A plurality of similar print rings with ratchets 3 are mounted on a common shaft 6. An intermittent driving gear 4 rotates when power is supplied to the motor. The intermittent gear 5 is driven by gear 4 and the print ring shaft 6 is rotated in the direction of arrow A. A spring 25 (FIG. 3) engages the shaft 6 and the print ring 1 such that the print ring 1 rotates in unison with the shaft 6. A detector 7, described more fully hereinafter, produces timing signals T corresponding to the position of the characters 2 on the print rings 1 as the print rings rotate. Upon the occurrence of a selected timing signal, electromagnets (not shown) are energized whereby selection pawls 30 are engaged with the ratchets 3 and the frictional engagement between the print ring shaft 6 and the springs 25 is released. Thereby a desired character 2 is stopped so as to be facing a print roller 31. When the shaft 6 has completed almost one rotation and all the characters 2, one on each print ring, have been selected, the face portion of the intermittent driving gear 4 and the root portion of the intermittent driven gear 5 are engaged with each other such that the print ring shaft 6 is prevented from further motion. Then the print roller 31 presses the selected characters against an ink ribbon (not shown) in consequence of which desired printing can be performed.

The driving gear 4 continues its rotation until a revolution has been completed. In so doing, the driven gear 5 is entirely released from engagement with the driving gear 4 when the teeth on the driven gear 5 oppose the recessed portion 34 of the driving gear 4 with clearance therebetween. By the action of spring 33 attached to the shaft 6, the shaft 6 then rotates in the reverse direction indicated by the arrow B and returns the shaft 6 to its original standby position. With the pawls 30 disengaged from the ratchets 3, the print rings also return to their standby position acted upon by the forces of spring 25. The paper 32 is advanced. The motor is stopped and the printer is ready for the next command to print which initiates another complete cycle. It should be noted that the mechanical features of this printer, namely, the driving and driven intermittent gears 4 and 5, the spring rings 1 with their characters 2, the ratchets 3 and pawls 30, the paper 32 and the print roller 31, are not novel parts of this invention. Therefore they are not described in further detail herein. A more complete description of the mechanical operations of the printer are found in copending U.S. application Ser. No. 828,685, which is incorporated herein by reference.

Operation of the printer requires reliable timing signals. The detector 7 comprises a printed circuit board 21 rotating once during each print cycle and brushes 22 fixed by a member 19. The printed circuit board 21 has contacts provided on its surface, as for example using copper foil 13 and 14. The contacts 13 on the circuit board 21 are spaced apart circumferentially by a distance equal to the spacing between the characters 2 on the print rings 1. The rotating circuit board 21 is fixedly attached to the shaft 6 and rotates in synchronism with the shaft and the print wheels. Accordingly, when the first character on the print wheel is aligned to the print roller 31, the first contact 13 on the rotating circuit board will be engaged by the brush 8. Accordingly, as the shaft 6 rotates, a series of contacts are made between brush 8 and contacts 13 indicative of the position of all the characters 2 on the print rings 1. Contacts 14 are placed on the rotating circuit board in positions between the positions of contacts 13. Brush 8 which contacts contacts 13 does not contact the contacts 14. Brush 9 makes contact with the foils 14 and 17 provided on the printed circuit 21. Because of the intermittent nature of the contacts 13 and 14 on the printed circuit board 21, the action of these contacts with the brushes is equivalent to the action of a single pole switch. FIG. 2 shows schematically the electrical interconnection between the contacts and the brushes and further shows the connection to a power supply V and the use of resistors 60 to complete a circuit which puts out three signals designated in FIG. 2 as T, S, and R. In every instance, it is the brush which acts as the moving pole of the single pole switch. It can be seen from FIG. 2 that brush 8 is fixedly connected to ground via a resistor 60. Brush 9 is connected to ground via a resistor 60 and similarly brush 10 is connected to ground via a resistor 60. The brush 11 is fixedly connected to foil contact 18 on the rotating circuit board 21 and to a positive voltage V. Foil contact 18 interconnects contact 15 with contact 15' and brush 11 rides on contact 15'. Foil contacts 13, 16, 14 and 17 connect electrically to foil contact 15. When the switch of brush 11 is closed, it can be seen that the output T is zero when brush 8 is in an open position. Correspondingly, the output S is zero when brush 10 is in the open position, and output R is zero when the brush 9 is in the open position. With the switch of brush 11 closed, the closing of the switch comprising brush 8 and contact 13 will produce an output V at the timing terminal T. Correspondingly, closing the switch comprised of brush 10 and contact 16 will produce an output V at the S or stop terminal. Correspondingly, closing the switch comprised of brush 9 and contacts 14, 17, will cause the R output to have a value V.

FIG. 4 shows a wave diagram as will be produced by the detector 7 in a printer having twelve characters 2 on each print wheel 1. One cycle of operation is indicated by the current conduction to the motor. It can be seen for one revolution of the shaft 6, that the brush 8 moving across the surface of contacts 13 will produce the timing signals T. Similarly, brush 9 moving over the contacts 14 on the rotating circuit board 21, will produce the auxiliary signal designated in FIG. 4 by the letter R. It should be noted that the auxiliary signal R occurs in the interval of time between the timing signals T. The tops of the wave forms T and R are irregular and jagged, representing the condition of erratic contact between the brushes and the foil contacts on the rotating circuit board 21. It is this common defect in the brush contact method of producing timing signals which has lead heretofore to the use of light sources, slotted discs and photo-detectors to produce timing signals. These irregular wave forms can cause erroneous actuation of circuits which are designed for true binary inputs. Erroneous printing can result.

In order to convert the erratic timing signal T into a uniformly contoured square wave pulse, the timing signal T is inputted to the set terminal of a flip-flop circuit 62 via an inverter 64. Simultaneously, the auxiliary signal R is inputted to the reset terminal of the flip-flop 62 via the inverter 66. The flip-flop circuit 62 is actuated by a negative going signal. Consequently, the flip-flop 62 is set and the output Q goes positive or high at the leading edge of the first timing signal $T_O$. The output Q of the flip-flop 62 remains high until flip-flop 62 is reset by the leading edge of the auxiliary signal $R_O$. The output Q remains low until the next timing signal T, that is, $T_1$, sets flip-flop 62 again. Accordingly, the output Q from flip-flop 62, that is, the converted timing signal, has its leading edge in registry with the leading edge of the original timing signal T. The trailing edge of the converted timing signal Q has its trailing edge in registry with the leading edge of the auxiliary signal R. Thus, a series of uniformly square pulses are provided at the output Q of flip-flop 62 which are in registry with the original incoming timing signals although the width of the converted timing signal Q may not exceed the timing signal T. As a consequence, brushes and contacts are used to detect the position of the print rings 1 without the normal hazard of mal-operation caused by chattering and noise of the brushes on the contacts.

Figure 5:
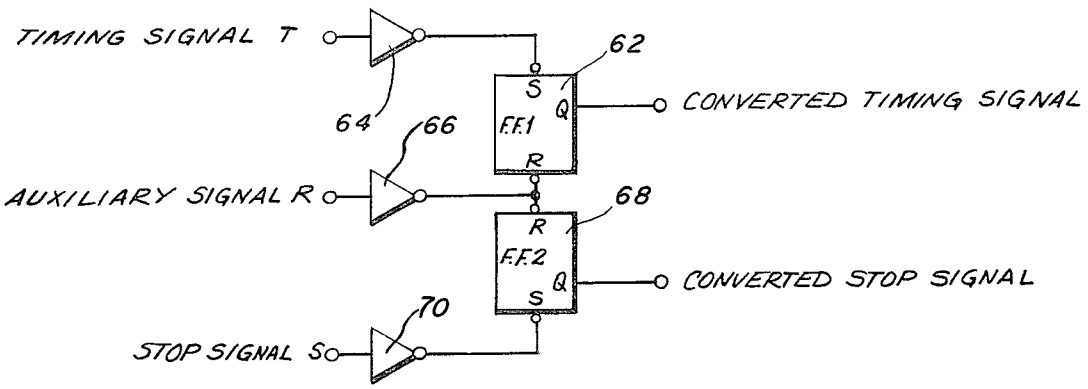
FIG. 5 shows logical circuits producing timing signals and a stop signal for the embodiment of FIG. 1.

Near the end of a revolution of the shaft 6, the brush 10 makes contact with the foil contact 16 on the rotating printed circuit board 21. This contact is made after all the print wheels 1 have been rotated and printing has been accomplished on the paper web 32. As seen in FIG. 5, the stop signal S is inputted via inverter 70 to a flip-flop 68. When the output of the flip-flip goes high, the motor is stopped. Because the flip-flop 68 is actuated by negative going signals, the output stop signal occurs upon the first occurrence of contact between the brush 10 and foil 16 even though it may be a noisy chattering contact. It should be noted that when the print cycle is initiated by sending current to the motor, an auxiliary signal $R_S$, produced by the contact of brush 9 with a contact 14, occurs prior to the initial timing signal $T_O$. This auxiliary signal $R_S$ is inputted to the reset terminal of flip-flop 68 via an inverter 66; as a result, the output Q of flip-flop 68 goes low upon the occurrence at the leadng edge of auxiliary signal $R_S$. Accordingly, the motor is free to run a complete revolution until the next stop signal is produced by a renewed contact between brush 10 and foil contact 16. The converted stop signal Q, outputted by flip-flop 68, is a true binary output with straight edges and flat top even though the original inputs which produce this signal, namely the stop signal S and the auxiliary signal $R_S$ are noisy as a result of chattering of contacts with brushes. The number of print characters 2 on each print wheel 1 may vary in different embodiments of this invention; the number of timing signals T is equal to the number of characters 2 on each print ring 1; the number of auxiliary signals R is equal to the number of characters 2 plus one signal $R_S$ which precedes the actual character signals and provides the low stop signal.

By converting the timing signals and the stop signals generated by the brushes and foil contacts on the rotating circuit board 21, it is possible to incorporate a mechanical detecting system in a small printer. The cost of such a design is extremely low and the power consumption for operation of a brush and contact switch is also extremely low. This makes possible a miniaturized printer operable over an extended period of time on a battery pack. Power consumption is determined based on the value of the resistors 60 shown in the circuit of FIG. 2. In a case where C-MOS is employed, a low current drain in the order of microamperes is required and power consumption is extremely low. Therefore, by selecting large resistors 60, a low power consumption can be achieved. The stop signal S is produced when the shaft 6 has rotated back to the condition of standby. The power source V to the detector can also be isolated since brush 11 is synchronized with the motor operation and rotation of the shaft 6.

In alternative embodiments of this invention, the brush and contact detector can be used in printers of other mechanical types and also in non-mechanical printers. A printer comprising a detector according to this invention, can provide high reliability at low cost and with low power consumption, and is the most suitable design for a portable electronic calculator operated by batteries.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A position detector for a miniaturized printer, said printer having a print ring rotating on a driven shaft, said print ring having print characters circumferentially disposed therearound, and means for positioning and for printing a selected one of said print characters, comprising:

a first electrical brush;

a plurality of first electrical contacts, said first electrical contacts moving relative to said first brush with a velocity proportional to the rotation of said shaft, said first contacts being spaced apart whereby intermittent connection is made between said first brush and said first contacts, the timing of said connections being indicative of the rotational position of said print characters;

a second electrical brush;

a plurality of second electrical contacts, said second electrical contacts moving relative to said second brush with a velocity proportional to the rotation of said shaft, said second contacts being spaced apart whereby intermittent connection is made between said second brush and said second contacts, the timing of said connections being indicative of the rotational position of said print characters;

said connections between said second brush and said second contacts occurring during the time interval between said connections between said first brush and said first contacts whereby a timing indication of print character positions is provided by said first brush and first contacts, and an auxiliary indication is provided by said second brush and said second contacts.

2. The position detector of claim 1 and further comprising first circuit means for outputting said timing and auxiliary indications as electrical timing and auxiliary signals respectively representative of the intermittent connection of said contacts and said brushes.

3. The position detector of claim 2, wherein said contacts move rotationally and said brushes are rotationally stationary.

4. The position detector of claim 3, wherein said contacts are incorporated on an integrated circuit board and said board is connected to and rotates with said driven shaft.

5. The position detector of claim 2, and further comprising second circuit means cooperating with said first circuit means for outputting a converted timing signal, said converted timing signal including pulses, the repetition rate of said pulses of said converted timing signal equalling the repetition rate of said connections between said first brush and said first contacts, the leading edge of said converted pulses being in registry with the leading edge of said electrical timing signals and the trailing edge of said converted pulses being in registry with the leading edges of said electrical auxiliary signals.

6. The position detector of claim 5, wherein said second circuit means includes a flip-flop having set and reset terminals, and said electrical timing signal is fed through an inverter to the set terminal of said flip-flop and said auxiliary timing signal is fed through an inverter to the reset terminal of said flip-flop.

7. The position detector of claim 2 and further comprising means for stopping said driven shaft at the end of a print cycle.

8. The position detector of claim 7, wherein said means for stopping includes:

a first additional contact in said plurality of said second contacts producing an auxiliary indication which precedes the first one in said print cycle of said timing indications generated by said first contacts; and an additional brush and a second additional contact making connection at the end of said print cycle; and third circuit means for outputting a converted electrical stop signal in response to the inputs of said preceding auxiliary indication and said end of cycle connection.

9. The position detector of claim 8, wherein said third circuit means includes a flip-flop having set and reset terminals, wherein said auxiliary signals are inputted through an inverter to the reset terminal of said flip-flop, and said stop signal is inputted through an inverter to the set terminal of said flip-flop, whereby the converted stop signal is binary, said converted stop signal going low in registry with the leading edge of said preceding auxiliary signal, and the converted stop signal going high in registry with the leading edge of said end-of-cycle signal.

10. The position detector of claim 9, wherein said contacts move rotationally and said brushes are rotationally stationary.

11. The position detector of claim 10, wherein said circuit means and said contacts are incorporated on an integrated circuit board, and said board is connected to and rotates with said shaft.

12. The position detector of claim 1, wherein said printer has at least one additional print ring with print characters rotating on said driven shaft, and means for positioning and printing a selected one of said print characters on each of said additional print rings.

* * * * *